US009713398B2

(12) United States Patent
Xavier da Silva

(10) Patent No.: US 9,713,398 B2
(45) **Date of Patent: *Jul. 25, 2017**

(54) CLOTHES HANGER WITH BASE

(71) Applicant: Ellie MacLaren Xavier da Silva, Naples, FL (US)

(72) Inventor: Ellie MacLaren Xavier da Silva, Naples, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/035,863

(22) PCT Filed: Nov. 10, 2014

(86) PCT No.: PCT/US2014/064847

§ 371 (c)(1),
(2) Date: May 11, 2016

(87) PCT Pub. No.: WO2015/070163

PCT Pub. Date: May 14, 2015

(65) Prior Publication Data

US 2016/0296054 A1 Oct. 13, 2016

Related U.S. Application Data

(63) Continuation of application No. 14/076,348, filed on Nov. 11, 2013, now Pat. No. 9,186,008.

(51) Int. Cl.
*A47G 25/14* (2006.01)
*A47G 25/74* (2006.01)

(52) U.S. Cl.
CPC ..... *A47G 25/14* (2013.01); *A47G 25/743* (2013.01)

(58) Field of Classification Search
CPC ..... A47G 25/14; A47G 25/743
See application file for complete search history.

(56) References Cited

U.S. PATENT DOCUMENTS

| | | | | |
|---|---|---|---|---|
| 1,351,817 | A * | 9/1920 | Walters | A47F 8/02 223/92 |
| 1,768,271 | A * | 6/1930 | Tardy | A47F 7/19 223/94 |
| 3,310,179 | A | 3/1967 | Cappuzzello | 211/113 |
| 3,452,881 | A | 7/1969 | Jamison | 211/119 |
| 3,746,223 | A | 7/1973 | Batts | 223/91 |
| 4,248,363 | A | 2/1981 | Zuckerman et al. | |
| 5,421,465 | A | 6/1995 | Dunner, Jr. | 211/115 |
| 5,642,841 | A | 7/1997 | Beaty | 223/85 |
| 5,881,931 | A | 3/1999 | Stanfield | 223/85 |
| D411,373 | S | 6/1999 | McKinney | D6/315 |

(Continued)

FOREIGN PATENT DOCUMENTS

EP 0910976 4/1999

*Primary Examiner* — Shaun R Hurley
*Assistant Examiner* — Andrew W Sutton
(74) *Attorney, Agent, or Firm* — Livingston Loeffler, P.A.; Edward M. Livingston, Esq.; Bryan L. Loeffler, Esq.

(57) ABSTRACT

A clothes hanger (1) having a plurality of hooks (8) located thereon for hanging tank tops or other strapped articles of clothing. The clothes hanger allows a user to hang multiple articles of clothing on the plurality of hooks, thereby conserving storage space in a closet. The positioning of the hooks allows the clothes hanger to remain level by being counterbalanced while hanging in a closet. An optional base (14) allows the hanger to be displayed on a counter, dresser or other flat surface.

14 Claims, 4 Drawing Sheets

(56) References Cited

U.S. PATENT DOCUMENTS

| | | | | |
|---|---|---|---|---|
| 5,950,884 | A | 9/1999 | Payne | 223/85 |
| 6,053,378 | A | 4/2000 | Doyel | 223/86 |
| 6,070,773 | A | 6/2000 | Pogoda | |
| 6,296,160 | B1 | 10/2001 | Murray | 223/88 |
| 7,118,014 | B2 | 10/2006 | Ali et al. | |
| D541,056 | S | 4/2007 | Magwood | D6/315 |
| 7,624,900 | B2 | 12/2009 | McLaughlin | |
| 7,628,302 | B2 | 12/2009 | Yau | |
| 8,070,025 | B1 | 12/2011 | Nelson | 223/88 |
| 2004/0020948 | A1 | 2/2004 | Harris | 223/85 |
| 2004/0079771 | A1 | 4/2004 | Salcedo | 223/85 |
| 2004/0159686 | A1 | 8/2004 | Huang | |
| 2007/0045360 | A1 | 3/2007 | Grimes | 223/85 |
| 2008/0308511 | A1 | 12/2008 | Ruelas | 211/85.3 |
| 2009/0057166 | A1 | 3/2009 | Nelson | 206/6.1 |
| 2012/0228342 | A1 | 9/2012 | Lewis | 223/88 |

* cited by examiner

CLOTHES HANGER WITH BASE

CROSS REFERENCE TO RELATED APPLICATION

This application claims the benefit under 35 U.S.C. 120 and 365(c) of co-pending prior International Patent Application No. PCT/US14/64847 filed on Nov. 10, 2014, which claims the benefit of U.S. patent application Ser. No. 14/076,348 filed on Nov. 11, 2013, which issued as U.S. Pat. No. 9,186,008 on Nov. 17, 2015. The patent applications identified above are incorporated herein by reference in its entirety to provide continuity of disclosure.

FIELD OF THE INVENTION

This invention relates to clothes hangers, and more particularly, to a clothes hanger used for hanging one or more articles of clothing with straps, such as tank tops, camisoles, bras, dresses and so forth, and/or for displaying accessories, such as necklaces, earrings and so forth.

BACKGROUND OF THE INVENTION

A clothes hanger is a device in the shape of human shoulders designed to facilitate the hanging of articles of clothing such as shirts, tops, jackets and so forth. Conventional hangers consist of wire hangers bent in a flattened triangle-like shape that continues into a hook at the top, wooden hangers cut into a boomerang-like shape or triangle-like shape having a hook protruding from the top, and plastic hangers molded into boomerang-like shape or triangle-like shapes with a hook located on top.

Many hangers have notches or loops located thereon to hang an article of clothing having shoulder straps. Each strap is secured to a single notch or single loop located on opposite sides of the hanger. The article of clothing then spans the length of the hanger and the notches or loops keep the article of clothing from sliding off ends of the hanger. However, a problem with such conventional hangers is that only one article of clothing may be hung on a single hanger. This means multiple articles of clothing are hung sided by side (each on separate hangers) on a closet hanging rod, thereby taking up extra space in a closet.

Therefore, a need exists for a clothes hanger that will allow a user to hang multiple articles of clothing thereon to conserve storage space while still making it easy to organize the articles of clothing for easy access to the clothing.

SUMMARY OF THE INVENTION

The primary object of the present invention is to provide a clothes hanger that will allow a user to hang multiple articles of clothing thereon to conserve storage space while still making it easy to organize the articles of clothing for easy access to the clothing.

The present invention fulfills the above and other objects by providing a hanger having a plurality of hooks located thereon for hanging multiple tank tops or other strapped articles of clothing. A plurality of hanging hooks extends from opposite sides of the hanger along the length of each side of the hanger. When multiple articles of clothing are placed on each side of the hanger, a counter balance is created so when multiple tank tops or other strapped articles of clothing are stored on the hanger, the hanger remains level. By hanging multiple articles of clothing on the single hanger, horizontal storage pace in a closet is saved. The hooks may be retractable into the body of the hanger and/or hingedly attached to the body of the hanger. In addition, the clothes hanger of the present invention may be used to store and organize jewelry.

An additional feature of the present invention is a base that allows the hanger to be displayed on a counter, dresser or other flat surface.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
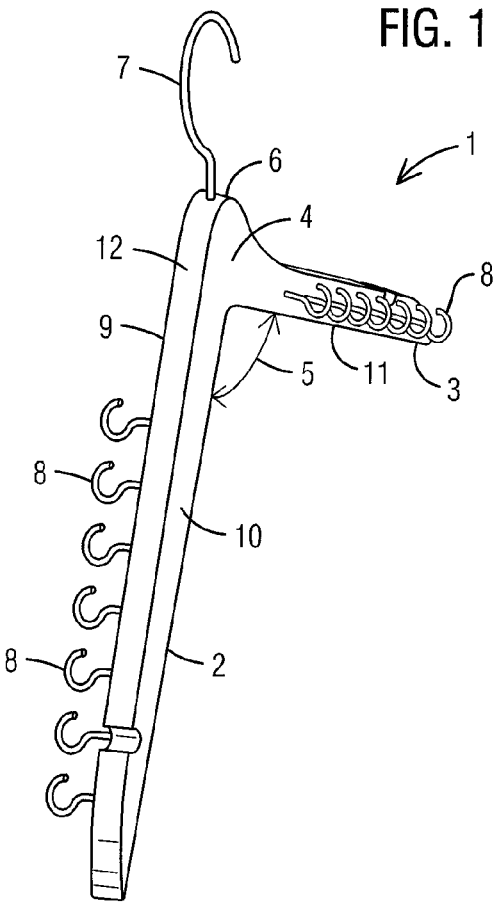
FIG. 1 is a perspective side view of a clothes hanger of the present invention.

For purposes of describing the preferred embodiment, the terminology used in reference to the numbered components in the drawings is as follows:

1. clothes hanger, generally
2. first side of clothes hanger
3. second side of clothes hanger
4. center of clothes hanger
5. horizontal angle
6. apex
7. rod hanging hook
8. strap hanging hook
9. rear surface of clothes hanger
10. front surface of clothes hanger
11. bottom surface of clothes hanger
12. top surface of clothes hanger
13. vertical angle
14. base
15. elongated arm
16. top end of elongated arm
17. bottom end of elongated arm
18. top surface of base
19. bottom surface of base
20. perimeter edge of base
21. panel
22. aperture
23. joint With reference to FIGS. 1-4, a perspective side view, a front view, a rear view and a top view, respectively, of a clothes hanger 1 of the present invention are illustrated. The clothes hanger 1 comprises a first side 2 and a second side 3 meeting at a center 4 of the clothes hanger 1 and extending away from each other a predetermined distance. The first side 2 and second side 3 may be parallel to each other or the first side 2 and second side 3 of the clothes hanger 1 may angle downward from the center 4 to create a horizontal angle 5 and a substantially boomerang-like shape having an apex 6. A rod hanging hook 7 extends upward from the center 4 of the clothes hanger 1. The rod hanging hook 7 is used to hang the clothes hanger 1 in a closet from a hanging rod. At least two strap hanging hooks 8 are located on the first side 2 and at least two strap hanging hooks 8 are located on the second side 3. Each strap hanging hook 8 located on the first side 2 is preferably located to mirror the location of each strap hanging hook 8 located on the second side 3. For example, each strap hanging hook 8 is an equal distance from the center 4 of the clothes hanger 1 as compared to the countering strap hanging hook 8 located on the opposite side of the clothes hanger 1. The placement or location of the strap hanging hooks 8 allows for the clothes hanger 1 to be counterbalanced so the clothes hanger 1 remains in a level position while hanging in a closet. The strap hanging hooks 8 located on the first side 2 may also be located on a surface that is opposite to a surface the strap hanging hooks 8 located on the second side 3 are located on. As illustrated here, the strap hanging hooks 8 located on the first side 2 are located on a rear surface 9 of the clothes hanger 1 and the strap hanging hooks 8 located on the second side 3 are located on a front surface 10 of the clothes hanger 1. This further allows for the clothes hanger 1 to be counterbalanced so the clothes hanger 1 remains in a level position while hanging in a closet. However, although the strap hanging hooks 8 are illustrated as being located on the front surface 10 and the rear surface 9 of the clothes hanger 1, the strap hanging hooks 8 may also be located on a bottom surface 11 of the clothes hanger 1, a top surface 12 of the clothes hanger 1 and/or be notches located on a top surface 12 of the clothes hanger 1.

In addition, the first side 2 and second side 3 may angle outward from each other in the same or opposite directions to create a vertical angle 13 at the center 4 of the clothes hanger 1. This vertical angle 13 provides for a further counter balance to the clothes hanger 1.

Figure 2:
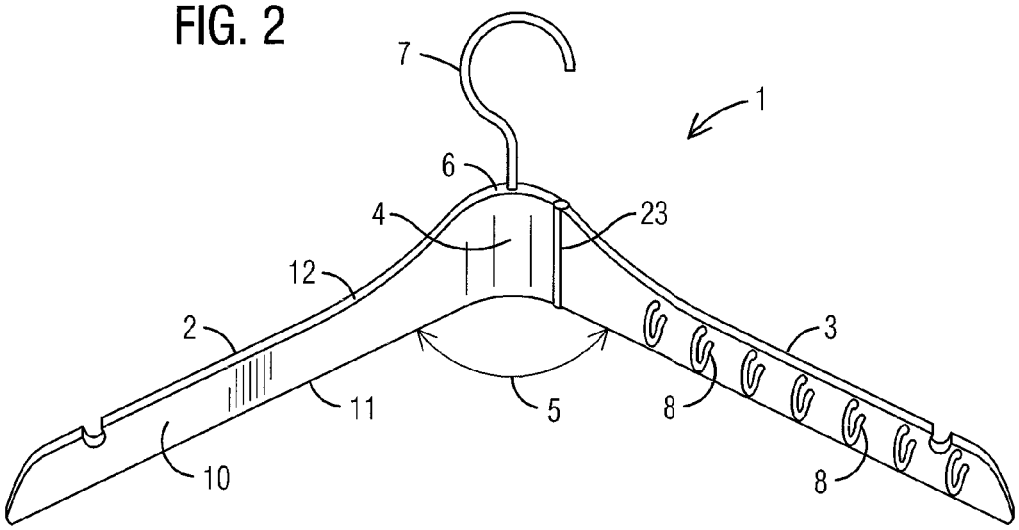
FIG. 2 is a front view of a clothes hanger of the present invention.
Figure 3:
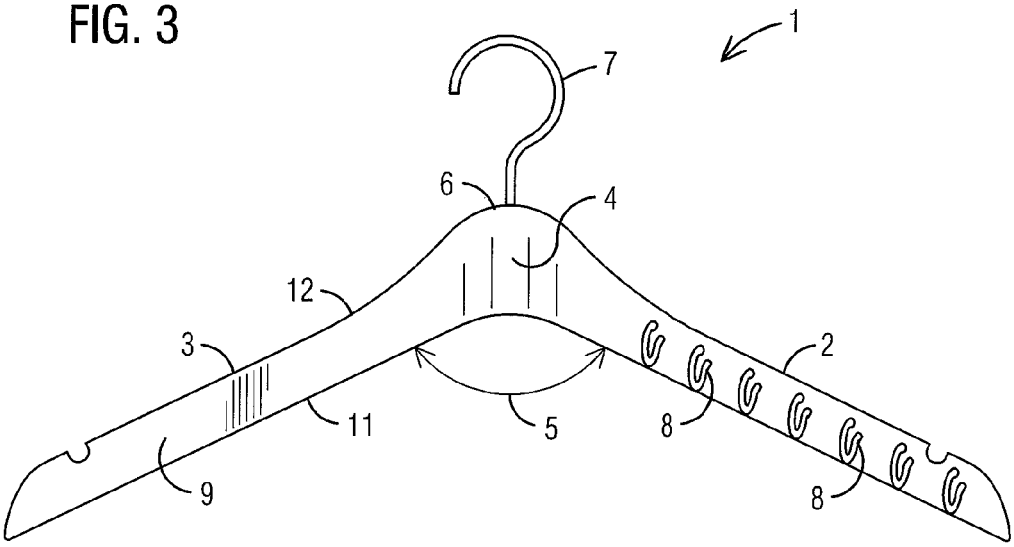
FIG. 3 is a rear view of a clothes hanger of the present invention.
Figure 4:
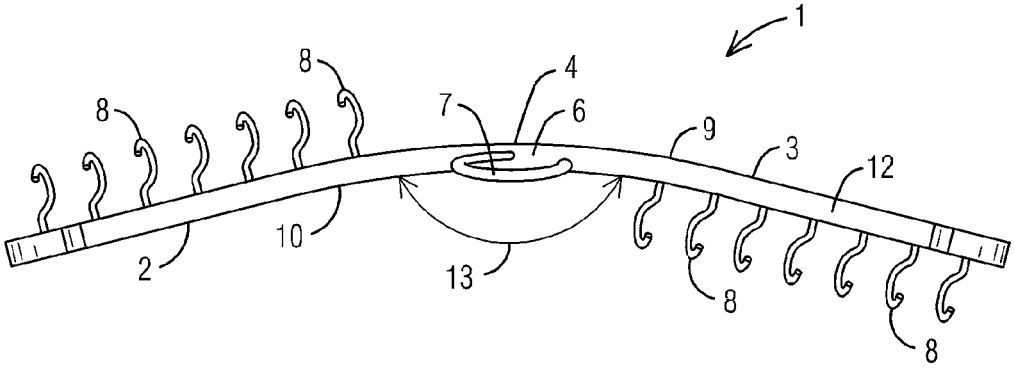
FIG. 4 is a top view of a clothes hanger of the present invention.

The hanger 1 of the present invention may also comprise at least one joint 23 located thereon, such as a hinge, locking hinge, male/female interlocking locking joint, pivot point or other type of engagement means that allows the hanger 1 to be collapsible for travel as illustrated in FIG. 2.

Figure 5:
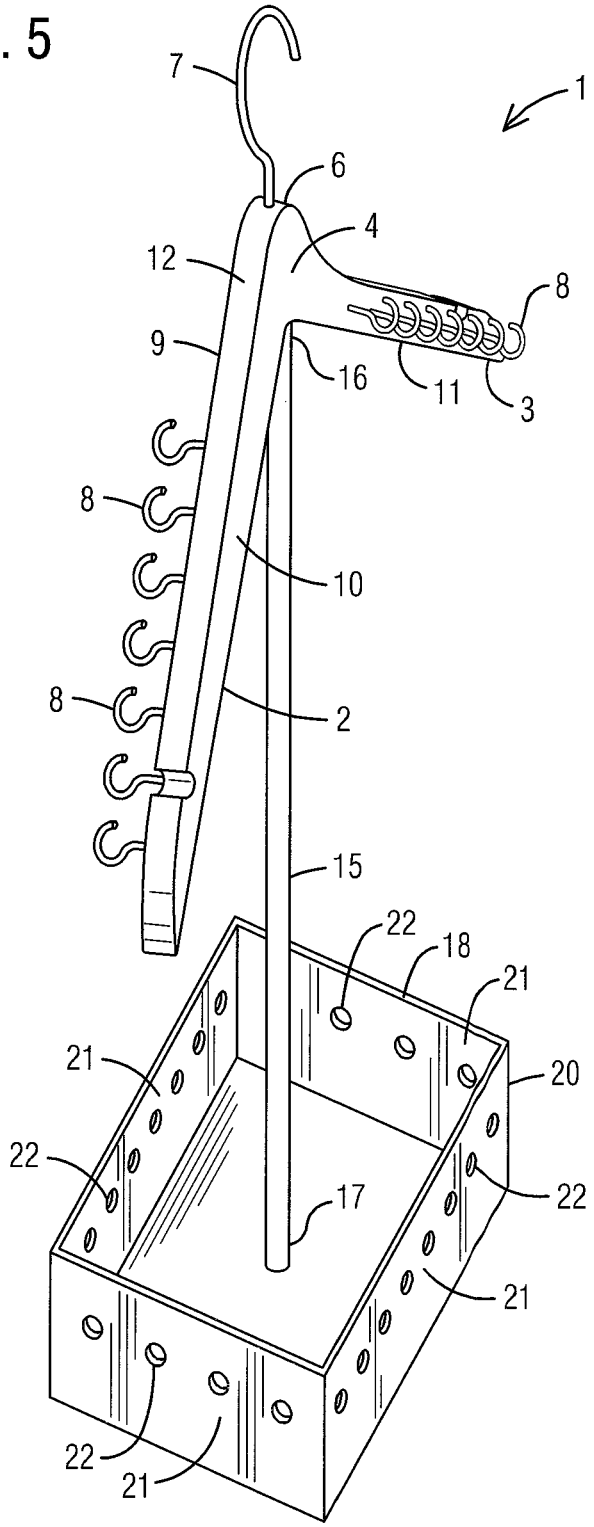
FIG. 5 is a perspective side view of a clothes hanger of the present invention having a base.
Figure 6:
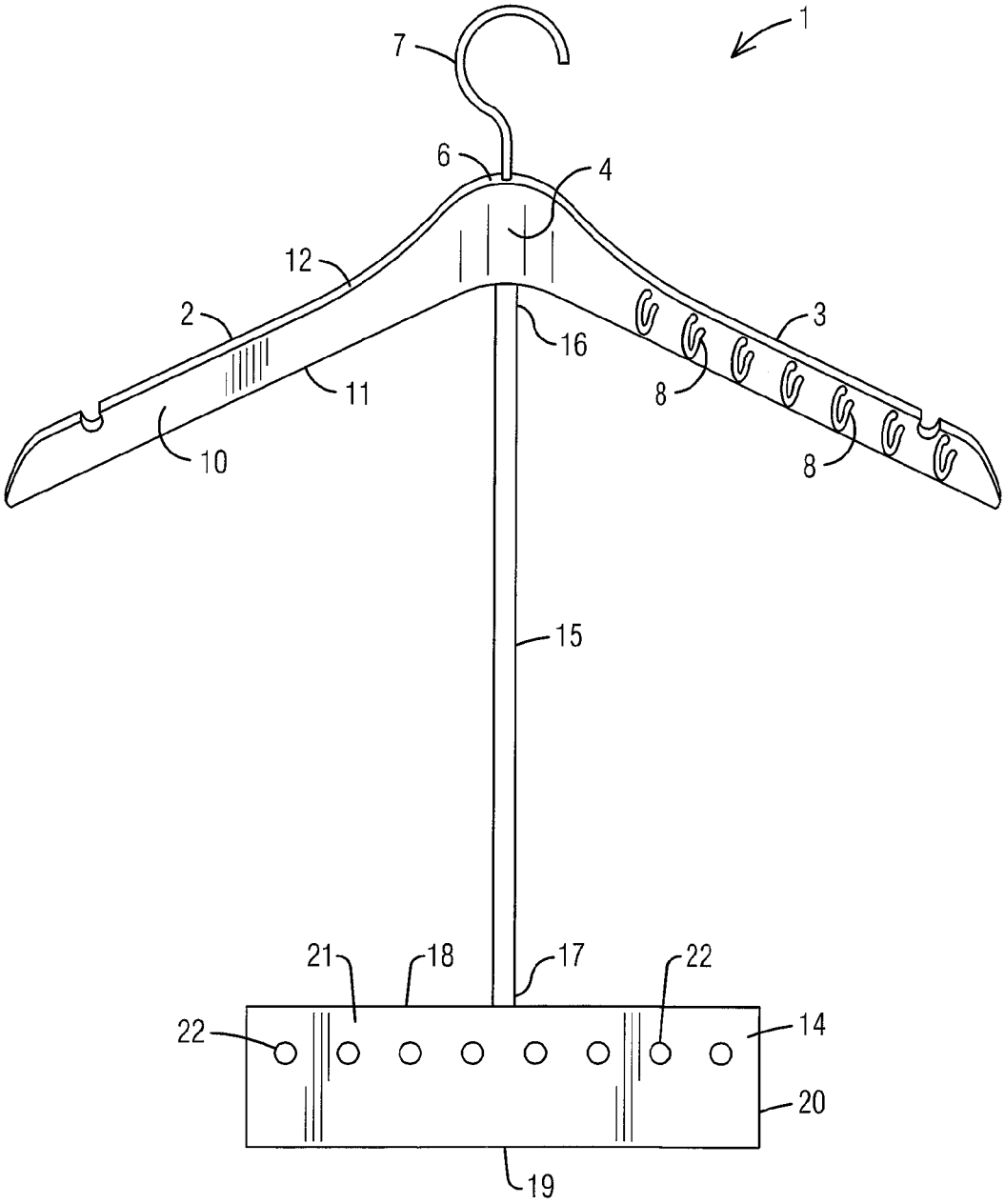
FIG. 6 is a perspective side view of a clothes hanger of the present invention having a base.

With reference to FIGS. 5 and 6, a perspective side view and a front view, respectively, of a clothes hanger 1 of the present invention having a base 14 are illustrated. An elongated arm 15 having a top end 16 and a bottom end 17 extends downward from the center 4 of the clothes hanger 1 a predetermined distance where the bottom end 16 connects to a base 14 having a top surface 18, a bottom surface 19, and at least one perimeter edge 20. At least one panel 21 may extend upward from the perimeter edge 20 and have at least one aperture 22 located thereon. A user may store earrings on the at least one panel 21 by connecting the earrings to the apertures 22.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A clothes hanger for hanging strapped articles of clothing comprising:

a first side and a second side each extending a predetermined distance away from each other at a center of the clothes hanger;

a plurality of strap hanging hooks located on a front surface of the first side of the clothes hanger;

a rear surface of the first side of the clothes hanger being a substantially planar surface with no strap hanging hooks located thereon;

a plurality of strap hanging hooks located on a rear surface of the second side of the clothes hanger;

a front surface of the second side of the clothes hanger being a substantially planar surface with no strap hanging hooks located thereon; said number of strap hanging hooks located on the first side of the clothes hanger is equal to said number of strap hanging hooks located on the second side of the clothes hanger;

the plurality of strap hanging hooks located on the first side mirror the location the plurality of strap hanging hooks located on the second side in regards to the distance each strap hanging hook is located from the center of the clothes hanger; and an elongated arm extending downward from the center of the clothes hanger a predetermined distance where a bottom end of the elongated arm connects to a base having a top surface, a bottom surface, and at least one perimeter edge.

2. The clothes hanger of claim 1 further comprising:

at least one panel extending upward from the at least one perimeter edge and having at least one aperture located thereon.

3. The clothes hanger of claim 1 wherein:

said plurality of strap hanging hooks located on the first side are each substantially C-shaped hooks; and said plurality of strap hanging hooks located on the second side are each substantially C-shaped hooks.

4. The clothes hanger of claim 1 wherein:

said first side of the clothes hanger angles downward from the second side of the clothes hanger, thereby creating horizontal angle and a substantially boomerang shape having an apex located on a top surface of the clothes hanger.

5. The clothes hanger of claim 1 wherein:

said first side and second side angle outward from each other to create a vertical angle at the center of the clothes hanger.

6. A clothes hanger for hanging strapped articles of clothing comprising:

a first side and a second side each extending a predetermined distance away from each other at a center of the clothes hanger;

a plurality of strap hanging hooks located on a rear surface of the first side of the clothes hanger;

a front surface of the first side of the clothes hanger being a substantially planar surface with no strap hanging hooks located thereon;

a plurality of strap hanging hooks located on a front surface of the second side of the clothes hanger;

a rear surface of the second side of the clothes hanger being a substantially planar surface with no strap hanging hooks located thereon;

said number of strap hanging hooks located on the first side of the clothes hanger is equal to said number of strap hanging hooks located on the second side of the clothes hanger;

and the plurality of strap hanging hooks located on the first side mirror the location the plurality of strap hanging hooks located on the second side in regards to the distance each strap hanging hook is located from the center of the clothes hanger; and an elongated arm extending downward from the center of the clothes hanger a predetermined distance where a bottom end of the elongated arm connects to a base having a top surface, a bottom surface, and at least one perimeter edge.

7. The clothes hanger of claim 6 further comprising:

at least one panel extending upward from the at least one perimeter edge and having at least one aperture located thereon.

8. The clothes hanger of claim 6 wherein:

said first side of the clothes hanger angles downward from the second side of the clothes hanger, thereby creating horizontal angle and a substantially boomerang shape having an apex located on a top surface of the clothes hanger.

9. The clothes hanger of claim 6 wherein:

said first side and second side angle outward from the center of the clothes hanger to create a vertical angle at the center of the clothes hanger.

10. A clothes hanger for hanging strapped articles of clothing comprising:

a first side and a second side each extending a predetermined distance away from each other at a center of the clothes hanger;

a plurality of strap hanging hooks located on a front surface of the first side of the clothes hanger;

a rear surface of the first side of the clothes hanger being a substantially planar surface with no strap hanging hooks located thereon;

a plurality of strap hanging hooks located on a rear surface of the second side of the clothes hanger;

a front surface of the second side of the clothes hanger being a substantially planar surface with no strap hanging hooks located thereon; said number of strap hanging hooks located on the first side of the clothes hanger is equal to said number of strap hanging hooks located on the second side of the clothes hanger;

the plurality of strap hanging hooks located on the first side mirror the location the plurality of strap hanging hooks located on the second side in regards to the distance each strap hanging hook is located from the center of the clothes hanger; and an elongated arm extending downward from the center of the clothes hanger a predetermined distance where a bottom end of the elongated arm connects to a base having a top surface, a bottom surface, and at least one perimeter edge.

11. The clothes hanger of claim 10 further comprising:

at least one panel extending upward from the at least one perimeter edge and having at least one aperture located thereon.

12. The clothes hanger of claim 10 wherein:

said plurality of strap hanging hooks located on the first side are each substantially C-shaped hooks; and said plurality of strap hanging hooks located on the second side are each substantially C-shaped hooks.

13. The clothes hanger of claim 10 wherein:

said first side of the clothes hanger angles downward from the second side of the clothes hanger, thereby creating horizontal angle and a substantially boomerang shape having an apex located on a top surface of the clothes hanger.

14. The clothes hanger of claim 10 wherein:

said first side and second side angle outward from each other to create a vertical angle at the center of the clothes hanger.

* * * * *